US010934765B2

(12) United States Patent
Walsh et al.

(10) Patent No.: US 10,934,765 B2
(45) Date of Patent: Mar. 2, 2021

(54) CHASSIS BASED FENESTRATION SYSTEMS

(71) Applicant: Sunrise Windows, LLC, Temperance, MI (US)

(72) Inventors: John H. Walsh, Oregon, OH (US); Gary J. Spoering, Deerfield, MI (US); Rolf J. Ohrstrom, North York (CA)

( * ) Notice: Subject to any disclaimer, the term of this patent is extended or adjusted under 35 U.S.C. 154(b) by 0 days.

(21) Appl. No.: 16/780,286

(22) Filed: Feb. 3, 2020

(65) Prior Publication Data

US 2020/0173223 A1 Jun. 4, 2020

Related U.S. Application Data

(63) Continuation of application No. 15/665,531, filed on Aug. 1, 2017, now Pat. No. 10,550,623.

(60) Provisional application No. 62/369,471, filed on Aug. 1, 2016.

(51) Int. Cl.
*E06B 1/30* (2006.01)
*E06B 1/28* (2006.01)

(52) U.S. Cl.
CPC . *E06B 1/30* (2013.01); *E06B 1/28* (2013.01)

(58) Field of Classification Search
CPC ..... E06B 1/30; E06B 1/28
USPC ..... 52/204.5, 204.62, 204.53, 204.54, 211, 52/212
See application file for complete search history.

(56) References Cited

U.S. PATENT DOCUMENTS 4,193,238 A * 3/1980 Chalmers ..... E06B 1/34 52/105
4,335,552 A * 6/1982 Blanchett ..... E06B 3/645 52/202
4,341,048 A * 7/1982 Minter ..... E06B 1/34 49/504
4,407,100 A * 10/1983 Huelsekopf ..... E06B 1/30 49/504
4,944,118 A * 7/1990 Biro ..... E06B 3/44 49/504
4,982,530 A * 1/1991 Palmer ..... E06B 3/26345 49/504
4,999,958 A * 3/1991 Harrison ..... E06B 1/02 49/455
5,222,343 A * 6/1993 Anderson ..... E04F 19/061 52/211
5,669,192 A * 9/1997 Opdyke ..... E06B 1/34 52/211

(Continued)

*Primary Examiner* — Joshua K Ihezie
(74) *Attorney, Agent, or Firm* — Charles F. Charpie

(57) ABSTRACT

A fenestration system includes a chassis formed from left and right chassis stiles, and top and bottom chassis rails. The left and right chassis stiles having an outside longitudinal groove, an outside longitudinal ridge, an inside longitudinal groove and an inside longitudinal ridge. The top and bottom chassis rails having an outside longitudinal groove, an outside longitudinal ridge, an inside longitudinal groove and an inside longitudinal ridge. Outside stile covers are configured to engage the longitudinal outside groove and the longitudinal outside ridge of the chassis stile. Inside stile covers are configured to engage the inside longitudinal groove and the inside longitudinal ridge of the chassis stile. Outside rail covers are configured to engage the longitudinal outside groove and the longitudinal outside ridge of the chassis rail. Inside rail covers are configured to engage the inside longitudinal groove and the inside longitudinal ridge of the chassis rail.

11 Claims, 10 Drawing Sheets

(56) References Cited

U.S. PATENT DOCUMENTS

| | | | | | |
|---|---|---|---|---|---|
| 5,779,384 | A * | 7/1998 | Olsen | B29C 65/08 | 160/381 |
| 5,836,119 | A * | 11/1998 | Emmanuel | E06B 3/26345 | 52/204.71 |
| 6,148,883 | A * | 11/2000 | Wilson | B27F 7/00 | 144/329 |
| 6,192,638 | B1 * | 2/2001 | Wang | E06B 1/10 | 49/504 |
| 6,263,626 | B1 * | 7/2001 | Gerhardt | E06B 3/303 | 52/204.5 |
| 6,530,190 | B2 * | 3/2003 | Conachen | E06B 3/44 | 49/483.1 |
| 7,146,769 | B1 * | 12/2006 | Culverson | E06B 1/702 | 52/204.5 |
| 8,490,350 | B1 * | 7/2013 | Greely | E06B 1/34 | 52/211 |
| 8,584,410 | B2 * | 11/2013 | Furgerson | E06B 1/26 | 52/209 |
| 9,803,352 | B2 * | 10/2017 | Gosling | E06B 1/34 | |
| 10,550,623 | B2 * | 2/2020 | Walsh | E06B 1/34 | |
| 2008/0245001 | A1 * | 10/2008 | Alkoury | E06B 3/302 | 52/204.5 |
| 2009/0013636 | A1 * | 1/2009 | Wilson | E04F 19/02 | 52/718.01 |
| 2009/0044466 | A1 * | 2/2009 | Andres | E04F 19/02 | 52/204.53 |
| 2014/0215939 | A1 * | 8/2014 | Gosling | E06B 1/34 | 52/211 |
| 2016/0090775 | A1 * | 3/2016 | Albrecht | E06B 1/36 | 52/204.5 |

* cited by examiner

CHASSIS BASED FENESTRATION SYSTEMS

RELATED APPLICATIONS

This application is a continuation of pending U.S. Utility patent application Ser. No. 15/665,531, filed Aug. 1, 2017, which claims the benefit of U.S. Provisional Patent Application No. 62/369,471, filed Aug. 1, 2016, the disclosures of which are incorporated herein by reference in their entireties.

BACKGROUND

This invention involves chassis based systems for window sashes, door panels, and frames for windows and doors.

Fenestration systems made from vinyl based extrusions are known and they are widely used in new construction and in renovation. Wood is a popular alternative to vinyl. Fenestration systems made from vinyl are widely regarded as being superior to wood fenestration systems in many ways including ease of manufacturing, durability, and performance, for example. However, wood fenestration systems are regarded by many as being aesthetically superior to currently available vinyl systems. Thus, consumers are faced with a choice between vinyl based systems with their superior performance and durability characteristics, and wood based systems which many consider to be aesthetically superior to vinyl.

Stiles and rails in a vinyl window sash, for example, are made from extrusions that have been cut to size and welded together at the corners. For maximum strength and ease of manufacturing, the extrusions are cut at forty-five degree angles and then welded. This is also the case for vinyl door panel frames, window frames, and door frames. They are made from extrusions that have been cut to size and welded together at the corners. In this specification, window sash frames, door panel frames, window frames, and door frames may be referred to generally as fenestration frames.

The term weld, in this specification, is used to refer to a case where the ends of two fenestration frame members have been heat bonded and/or chemically bonded, without regard to whether or not there is also a mechanical connection provided between the frame members.

The fenestration market demands options in terms of the color and appearance of the visible components of an installed window or door, i.e., the window sash frame, the door panel frame, and the window and door frames. Vinyl fenestration frame members are typically white when they are extruded. Color can be added to vinyl compositions before they are extruded, but it is not realistic to do this in cases where it is desired to offer a broad range of colors to customers. One of the biggest aesthetic complaints of vinyl windows are the welded corners, since most commonly these leave a protruding stand-off flange above the surface of the window, These flanges are typically cleaned by automated machines to minimize the size, but if reduced too small, then the structural integrity of the welded joint can fail. One method to overcome this is called "shadow grooving", in which the extrusions are made with thicker walls and the weld surface is a larger area, and the material can be removed below the surface of the profiles. This shadow groove is the opposite of the stand-off flange and more acceptable on white windows, but not acceptable on colored windows.

Weld sites in fenestration frames made from white vinyl extrusions can be cleaned up by sanding and buffing to provide an aesthetically acceptable sash frame. Weld sites in fenestration frames made from non-white vinyl extrusions also can be cleaned up by sanding and buffing, but the weld sites and adjacent portions of the frame are generally not aesthetically acceptable, without further treatment. Further, production of vinyl extrusions in more than one color is unmanageable from the standpoint of the extruder and from the standpoint of the manufacturer.

Fenestration frames made from white vinyl extrusions can be painted, thereby making it possible to offer customers a choice of color options. However, from a manufacturing standpoint, it is undesirable to add a paint shop operation to the manufacturing operation. Further, a painted vinyl frame looks like a painted vinyl frame and it does not have the aesthetic appeal of a painted wood frame.

Fenestration frames made from white vinyl extrusions can be covered with a colored covering generally in the nature of a contact paper. However, durability and precise placement of this type of covering make this approach less than optimal. Further, a vinyl frame covered with a contact paper type material looks like a vinyl sash frame covered with contact paper and it does not have the aesthetic appeal of a painted wood frame.

The disadvantages of vinyl based systems discussed above lead some customers to accept the disadvantages of wood based systems in order to satisfy their preferences for the look and feel of wood based systems. Some customers are willing to accept the aesthetic limitations inherent in vinyl based systems in order to satisfy their preference for superior performance.

A system that provides the performance characteristics of vinyl based fenestration systems with the aesthetic appeal of wood fenestration systems is a highly desirable goal. However, up to now, such a system does not exist.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the chassis based fenestration systems.

The above objects as well as other objects not specifically enumerated are achieved by a fenestration system. The fenestration system includes a chassis formed from a left chassis stile, a right chassis stile, a top chassis rail and a bottom chassis rail. The left and right chassis stile, and the top and bottom chassis rails are formed from a polymeric material. The left and right chassis stile each having an outside surface with an outside longitudinal groove and an outside longitudinal ridge. The left and right chassis stile each having an inside surface with an inside longitudinal groove and an inside longitudinal ridge. The top and bottom chassis rails each having an outside surface with an outside longitudinal groove and an outside longitudinal ridge. The top and bottom chassis rails each having an inside surface with at least one longitudinal inside groove and an inside longitudinal ridge. A plurality of outside chassis stile covers each having a longitudinal outside ridge are configured to engage the longitudinal outside groove of a chassis stile and further having a longitudinal outside groove configured to engage the longitudinal outside ridge of a chassis stile. Each of the plurality of outside chasses stile covers is formed from a polymeric material. A plurality of inside chassis stile covers each having a longitudinal inside ridge are configured to engage the inside longitudinal groove of a chassis stile and further having a longitudinal inside ridge configured to engage the longitudinal ridge of a chassis stile. Each of the plurality of inside chasses stile covers is formed from a polymeric material. A plurality of outside chassis rail covers each having a longitudinal outside ridge are configured to engage the longitudinal outside groove of a chassis rail and further having a longitudinal outside groove configured to engage the longitudinal outside ridge of a chassis rail. Each of the plurality of outside chasses rail covers formed from a polymeric material and a plurality of inside chassis rail covers each having a longitudinal inside ridge are configured to engage the inside longitudinal groove of a chassis rail and further having a longitudinal inside ridge configured to engage the longitudinal ridge of a chassis rail. Each of the plurality of inside chasses rail covers is formed from a polymeric material.

Various objects and advantages of the methods of the chassis based fenestration systems will become apparent to those skilled in the art from the following detailed description, when read in light of the accompanying drawings

DETAILED DESCRIPTION

Figure 1:
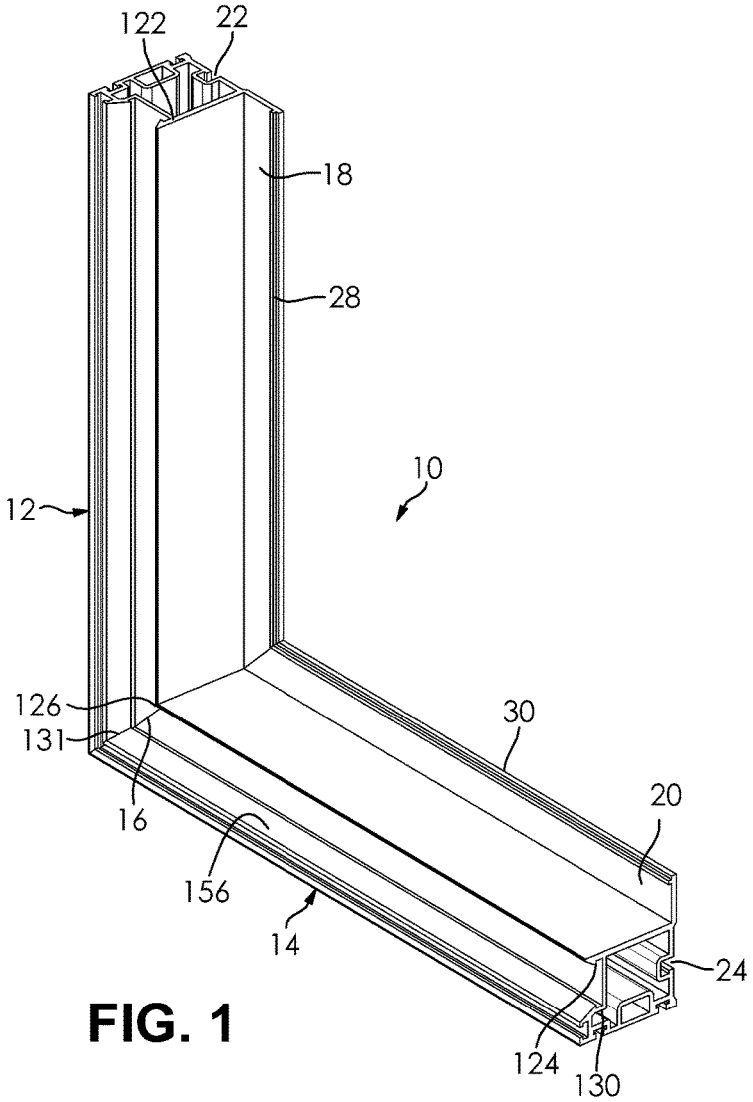
FIG. 1 is a perspective view of the inside of a portion of a fenestration frame chassis comprising two adjacent frame members with their ends welded together.

The quest has continued for a fenestration system that combines the performance characteristics of vinyl window and door systems with the aesthetic properties of wood window systems. The present invention is a fenestration system that fulfills that quest and more. The system is a chassis based fenestration frame system and comprises a chassis and covers for the inside and/or the outside of the chassis. The chassis is constructed of vinyl extrusions and the corners are welded for maximum strength. The chassis may be a sash frame chassis or a door panel frame chassis. The chassis may be a door frame or a window frame chassis. Mechanical fasteners may be used to reinforce the welds, if desired. Fenestration frame is used herein in a broad sense to refer to a sash frame, a window frame, a door panel frame, and a door frame. Examples of a fenestration frame system according to the invention, in the context of a top window sash frame and a bottom window sash frame, are described below with reference to FIGS. 1 through 21.

A portion of a fenestration frame chassis according to one example of the invention is indicated generally at 10 in FIGS. 1 through 4. The chassis portion illustrated comprises a portion of two frame members and a corner weld connection the two frame member portions. The frame chassis 10 is suitable for use as a sash frame chassis and will be described as such but it will be understood that includes fenestration frames of all types. A chassis stile 12 is welded to a bottom chassis rail 14. The chassis stile 12 and the bottom chassis rail 14 are extrusions, and the extrusions have the same profiles. The weld seam, indicated at 16, is positioned diagonally, at forty-five degrees, relative to the stile 12 and the rail 14. This construction affords the best strength in a welded joint between two extrusions. The welding may be carried out so that the weld is formed by heat. Alternatively, the welding may be carried out so that the weld is formed by chemical bonding. A combination of these approaches may be used to provide a heat and chemical bond between the stile 12 and the bottom rail 14. If desired, mechanical fasteners (not shown) may be used to mechanically connect the stile to the bottom rail, in addition to connecting these elements through a welded joint, according to the invention.

A glazing ridge 18 is provided on the inside of the chassis stile 12 with inside meaning the side that normally faces the interior of the building. A corresponding glazing ridge 20 is provided on the inside of the bottom chassis rail 14.

A first engagement member is provided on the inside of the stile 12. The first stile engagement member comprises a longitudinally extending groove 22 formed on the inside of the stile 12. A corresponding first engagement member is provided on the inside of the rail 14. The first rail engagement member comprises a longitudinally extending groove 24 in the rail 14. The grooves 22 and 24 intersect at, and in this example, they terminate at the weld 16 as indicated at 26.

A second engagement member is provided on the inside of the stile 12. The second stile engagement member comprises a longitudinally extending ridge 28 on the stile 12. The ridge 28 is formed along the interior free edge of the glazing ridge 20. A corresponding second engagement member is provided on the inside of the rail 14. The second rail engagement member comprises a longitudinally extending ridge 30 on the bottom rail 14. The ridge 30 is formed along the interior free edge of the glazing ridge 20.

Figure 3:
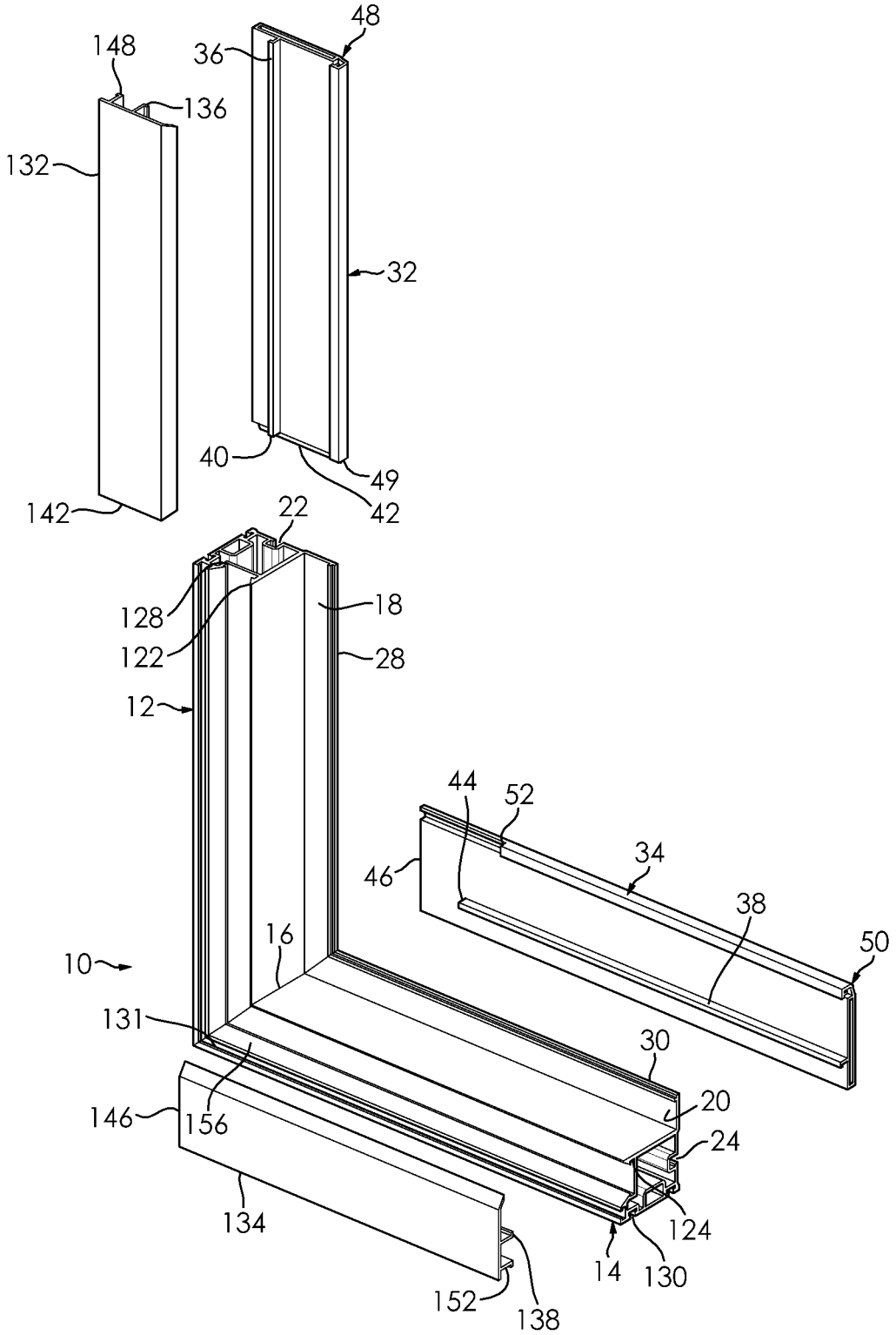
FIG. 3 is a perspective view of the outside of the fenestration frame chassis shown in FIGS. 1 and 2, with interior and exterior chassis covers positioned to be applied to the frame members.
Figure 4:
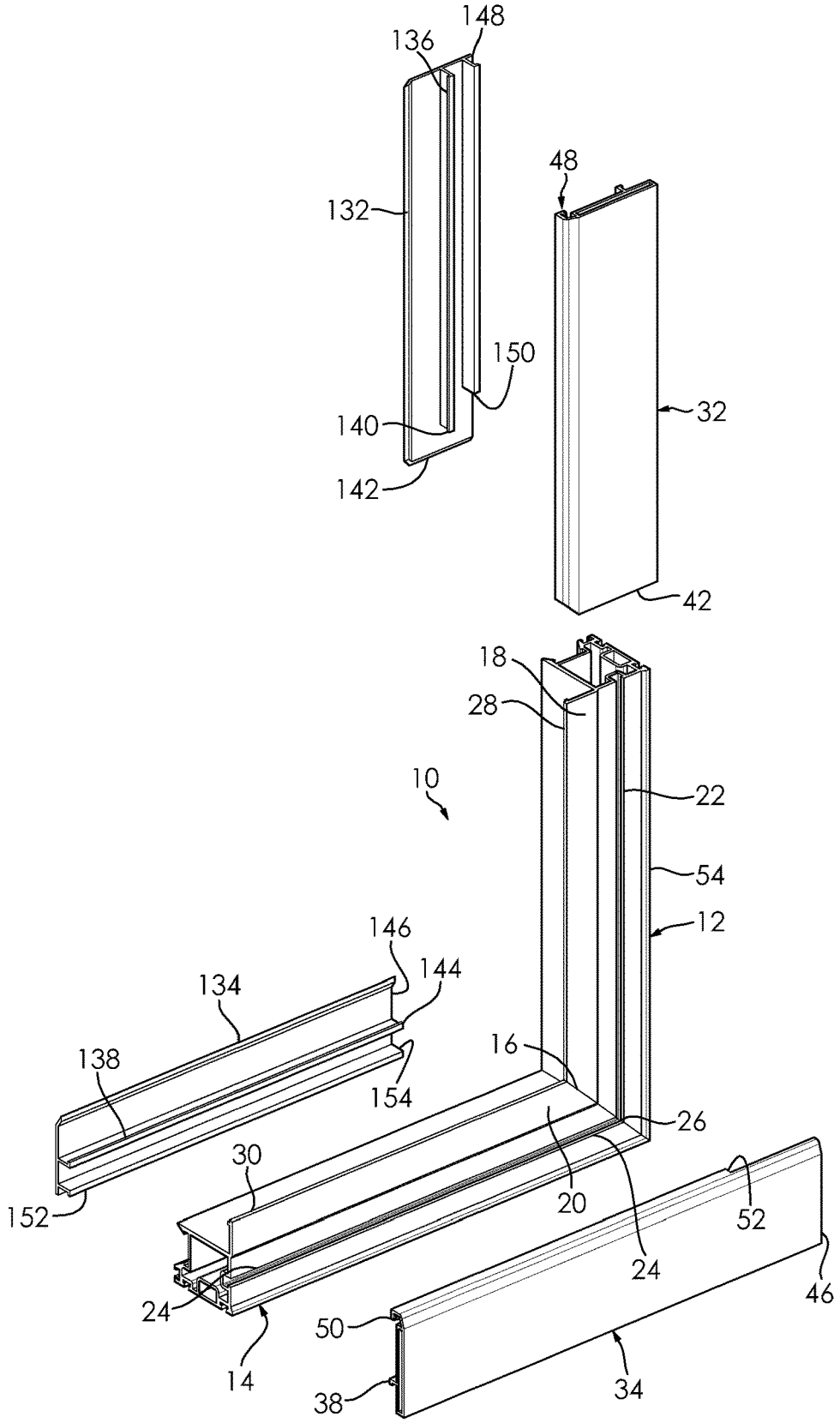
FIG. 4 is a perspective view of the inside of the fenestration frame chassis shown in FIGS. 1 through 3, with interior and exterior chassis covers positioned to be applied to the frame members.

An inside stile cover is indicated at 32 in FIGS. 3 and 4, and an inside rail cover is indicated at 34. A first engagement member is provided on the inside stile cover 32. The first inside stile cover engagement member comprises a longitudinally extending ridge 36 on the stile cover 32. A corresponding first engagement member is provided on the rail cover 34. The first rail cover engagement member comprises a longitudinally extending ridge 38 on the rail cover 34.

The ridge 36 on the inside stile cover 32 terminates in an end 40 which is adjacent to a lower end 42 of the stile cover 32. The ridge 36 cooperates with the groove 22 on the inside of the stile 12 to generally restrict relative movement between the stile 12 and the stile cover 32, except in a longitudinal direction. The ridge 38 on the rail cover 34 terminates in an end 44 which is spaced from an end 46 of the rail cover 34. The ridge 38 cooperates with the groove 24 on the inside of the rail 14 to generally restrict relative movement between the stile rail 14 and the rail cover 34, except in a longitudinal direction.

A second engagement member is provided on the inside stile cover 32. The second inside stile cover engagement member comprises a longitudinally extending groove, indicated at 48, on the stile cover 32. The groove 48 is formed along the interior edge of the inside stile cover 32. The portion of the stile cover which defines the groove 48 terminates in an end 49 which is adjacent to a lower end 42 of the stile cover 32. A corresponding second engagement member is provided on the inside rail cover 34. The second inside rail cover engagement member comprises a longitudinally extending groove, indicated at 50, on the bottom rail cover 34. The groove 50 is formed along the interior edge of the inside rail cover 34. The portion of the rail cover which defines the groove 50 terminates in an end 52 which is spaced from the end 46 of the rail cover 34.

When the first and second engagement members 22 and 28 of the stile 12 engage the first and second engagement members 38 and 50 of the inside stile cover 32, the stile cover 32 will be supported to the stile 12 and relative movement between the stile 12 and the stile cover 32, except in a longitudinal direction, will be prevented.

When the first and second engagement members 38 and 50 of the inside rail cover 34 engage the engagement members 24 and 30 of the rail 14, the rail cover 34 will be supported on the rail 14 and relative movement between the stile rail 14 the inside rail cover 34, except in a longitudinal direction, will be prevented.

When the inside rail cover 34 is supported on the rail 14, it can be slid to the left, in FIG. 3 (to the right in FIG. 4). When the end 44 of the ridge 38 engages the stile 12, in the vicinity of the groove 22, further movement of the rail cover will be prevented. Thus, the end 44 of the ridge 38 is a stop member which can cooperate with a stop member on the stile 12 to limit longitudinal movement of the rail cover 34. Alternatively, or in conjunction therewith, the end 52 of the portion of the rail cover which forms the groove 50 can cooperate with the stile 12 so that, when the inside rail cover 34 is supported on the rail 14, it can be slid longitudinally to the left, in FIG. 3 (to the right in FIG. 4) until the end 52 engages a stop portion of the stile 12. In other words, at least one stop member on the rail cover 34 engages at least one stop member on the adjacent chassis frame member (the stile 12, in this case) to prevent longitudinal movement of the cover in the direction of the adjacent chassis frame member. This stop structure is provided so that, when the end 46 of the cover 34 is to be aligned with an exterior edge 54 of the stile 12, longitudinal movement of the cover, to the left in FIG. 3 and to the right in FIG. 4, past the point where the end 46 of the cover 34 is aligned with the edge 54 of the stile 12, is prevented.

When the inside stile cover 32 is supported on the stile 12, and the rail cover 34 is positioned so that the end 46 is adjacent to the exterior edge 54 of the stile 12, the stile cover 32 is free to slide longitudinally until it slides downwardly to the extent that the end 42 of the stile cover 32 abuts the rail cover 34. In this case, the end 42 of the stile cover 32, and the rail cover 34 itself, function as stop members to prevent longitudinal movement of the stile cover 32 downwardly beyond a predetermined position.

A first engagement member is provided on the outside of the stile 12. The first outside stile engagement member comprises a longitudinally extending groove 122 which opens to the right (with reference to FIG. 2). A corresponding first outside engagement member is provided on the outside of the rail 14. The first outside rail engagement member comprises a longitudinally extending groove 124 which opens upwardly. The grooves 122 and 124 intersect at, and in this example they terminate at, the weld 16 as indicated at 126.

Figure 2:
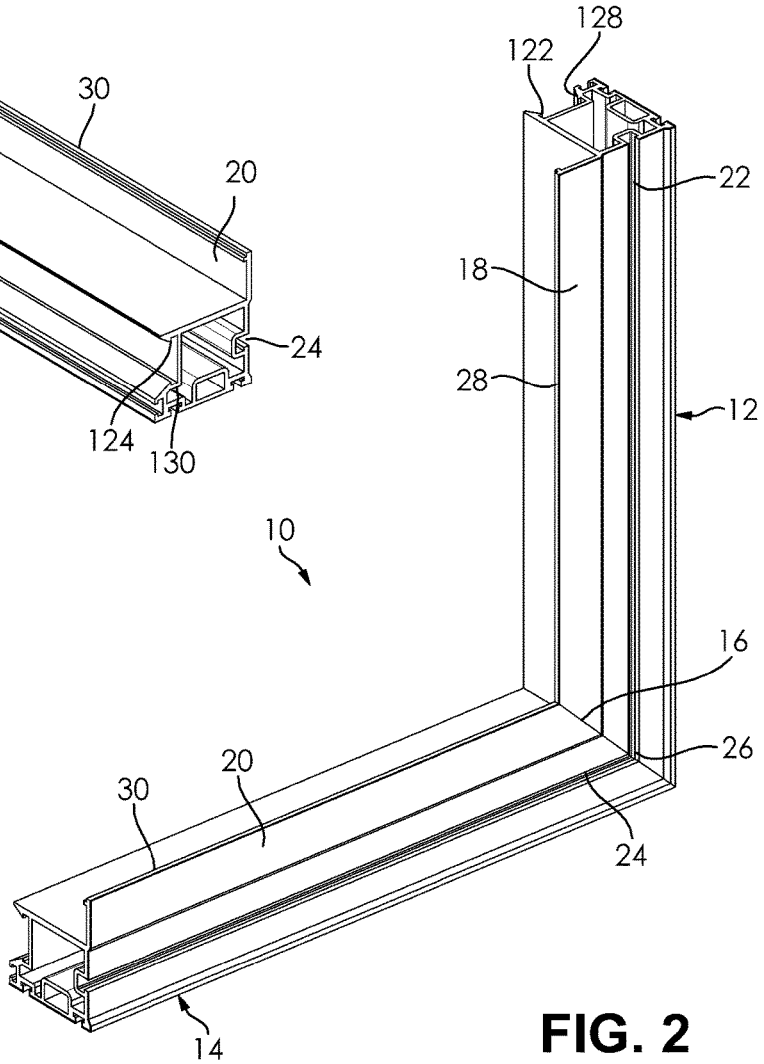
FIG. 2 is a perspective view of the outside of the fenestration frame chassis shown in FIG. 1.

A second engagement member is provided on the outside of the stile 12. The second outside stile engagement member comprises a longitudinally extending groove 128 which opens to the left (FIG. 2). A corresponding second outside rail engagement member is provided on the outside of the rail 14. The second outside rail engagement member comprises a longitudinally extending groove 130 which opens upwardly. The grooves 128 and 130 intersect at, and in this example they terminate at, the weld 16 as indicated at 131.

An outside stile cover is indicated at 132 in FIGS. 3 and 4, and an outside rail cover is indicated at 134. A first engagement member is provided on the outside stile cover 132. The first outside stile cover engagement member comprises a longitudinally extending ridge 136 on the stile cover 132. The ridge 136 has a hook edge which extends to the left (with reference to FIG. 4). A corresponding first outside engagement member is provided on the outside rail cover 134. The first outside rail cover engagement member comprises a longitudinally extending ridge 138 on the outside rail cover 134. The ridge 138 has a hook edge which extends upwardly.

The ridge 136 on the outside stile cover 132 terminates in an end 140 which is spaced from an end 142 of the stile cover 132. The ridge 136 cooperates with the groove 122 on the outside of the stile 12 to generally restrict relative movement between the stile 12 and the outside stile cover 132, but not in a longitudinal direction. The ridge 138 on the outside rail cover 134 terminates in an end 144 which is adjacent to an end 146 of the outside rail cover 134. The ridge 138 cooperates with the groove 124 on the outside of the rail 14 to generally restrict relative movement between the rail 14 and the outside rail cover 134, but not in a longitudinal direction.

A second engagement member is provided on the outside stile cover 132. The second outside stile cover engagement member comprises a longitudinally extending ridge 148 on the stile cover 132. The ridge 148 has a hook edge which extends to the right. The ridge 148 terminates in an end 150 which is spaced from the end 142 of the outside stile cover 132. A corresponding second engagement member is provided on the outside rail cover 134. The second outside rail cover engagement member comprises a longitudinally extending ridge 152 on the outside rail cover 134. The ridge 152 has a hook edge which extends downwardly. The ridge 152 terminates in an end 154 which is adjacent to the end 146 of the outside rail cover 134.

When the first and second engagement members 122 and 128 of the stile 12 engage the first and second engagement members 136 and 148 of the outside stile cover 132, the stile cover 132 will be supported on the stile 12 and relative movement between the stile 12 and the stile cover 132, except in a longitudinal direction, will be prevented.

When the first and second engagement members 138 and 152 of the outside rail cover 134 engage the engagement members 124 and 130 of the rail 14, the rail cover 134 will be supported on the rail 14 and relative movement between the stile rail 14 the outside rail cover 134, except in a longitudinal direction, will be prevented by the engagement.

When the outside stile cover 132 is supported on the stile 12, it can be slid downwardly until a stop member on the stile cover 132 engages a stop member on the rail 14. The stile cover stop member may be one of, or a combination of, the end 140 of the ridge 136, the end 150 of the ridge 148, and the end 142 of the outside stile cover 132. As seen in FIGS. 1 and 3, an outwardly extending ledge 156 is provided on the rail 14. If the outside rail cover 132 is slid downwardly until the end 142 of the outside stile cover 132 engages the ledge a portion of the rail 14, further downward movement of the rail cover 132 will be prevented.

When the outside rail cover 134 is supported on the rail 14, and the outside stile cover 132 is positioned so that the end 142 is adjacent to the ledge 156, the outside rail cover 134 is free to slide longitudinally to the left in FIG. 3 (to the right in FIG. 4) until the end 146 of the rail cover 134 abuts the outside stile cover 132. In this case, the end 146 of the rail cover 134 and the outside stile cover 132 function as stop members to prevent longitudinal movement of the rail cover 134 beyond a predetermined position.

Figure 5:
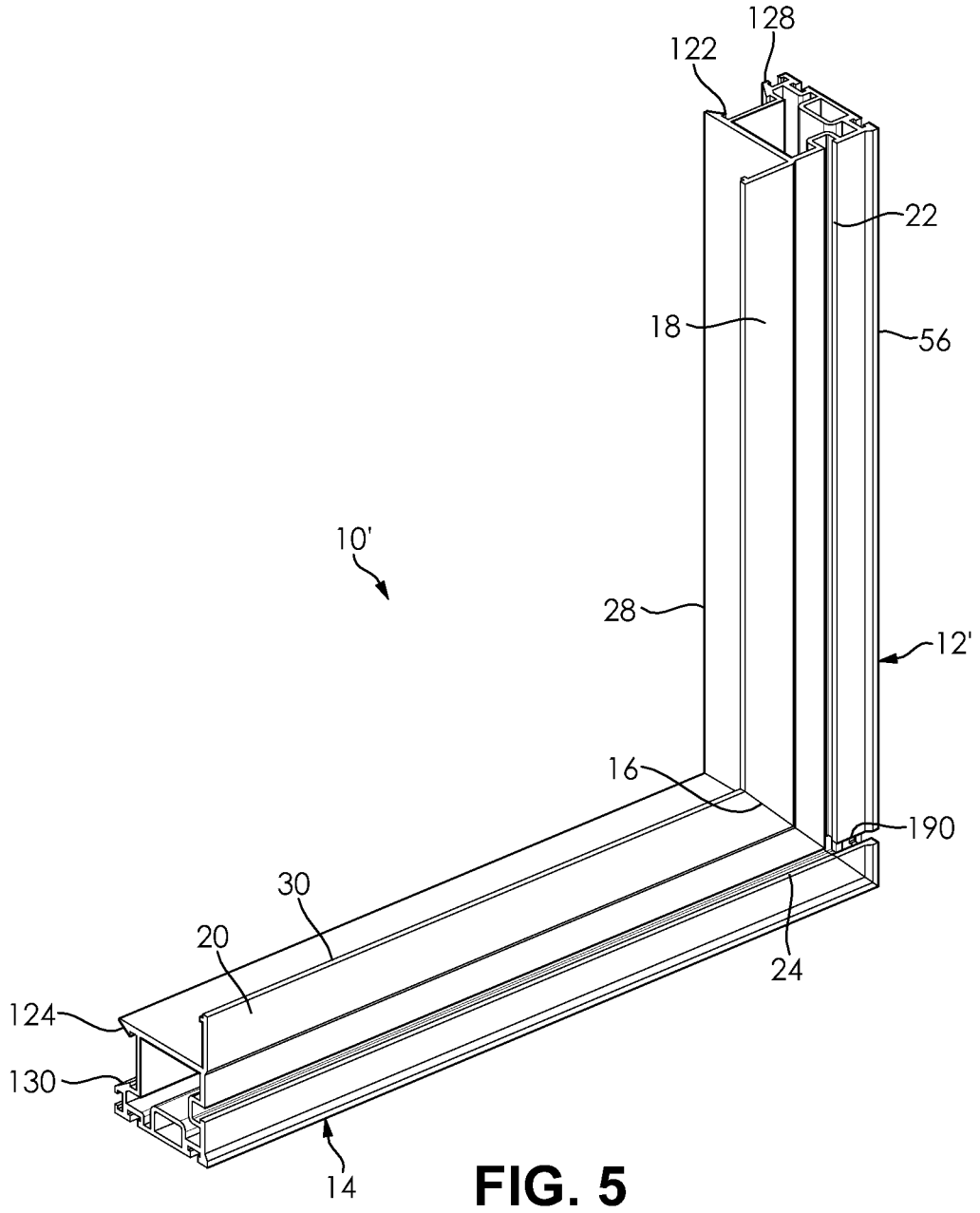
FIG. 5 is a perspective view of the inside of a portion of a fenestration frame chassis comprising two adjacent frame members with their ends welded together.

A different embodiment of a portion of a fenestration frame chassis according to one example of the invention is indicated generally at 10' in FIG. 5. In this embodiment, the engagement member, i.e., the groove 24 in the rail 14 is aligned with a groove indicated at 190 in a modified stile 12'. In other words, there is not a stile stop member associated with the groove 24. One result is that a ridge, i.e., an engagement member of an inside rail cover may be inserted into the groove 190, and the inside rail cover can be slid into position as opposed to, for example, being snapped into place. Longitudinal movement of the cover can be controlled and prevented if the cover is provided with a stop member to engage the glazing ridge on the stile 12', or another stop member provided on the stile 12'. Alternatively, the rail cover could be designed to be positioned so that its end is recessed from the exterior edge 56 of the stile 12'. In this case, longitudinal movement of the inside rail cover could be prevented by engagement with an inside stile cover in a manner such as the one described above for the inside stile cover 32.

Figure 6A:
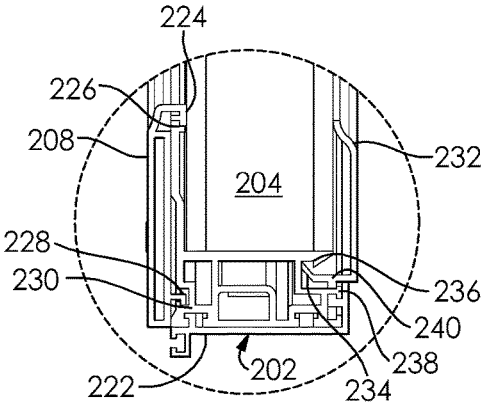
FIG. 6A is a cross sectional view of the bottom rail of the top sash shown in FIG. 6.
Figure 6:
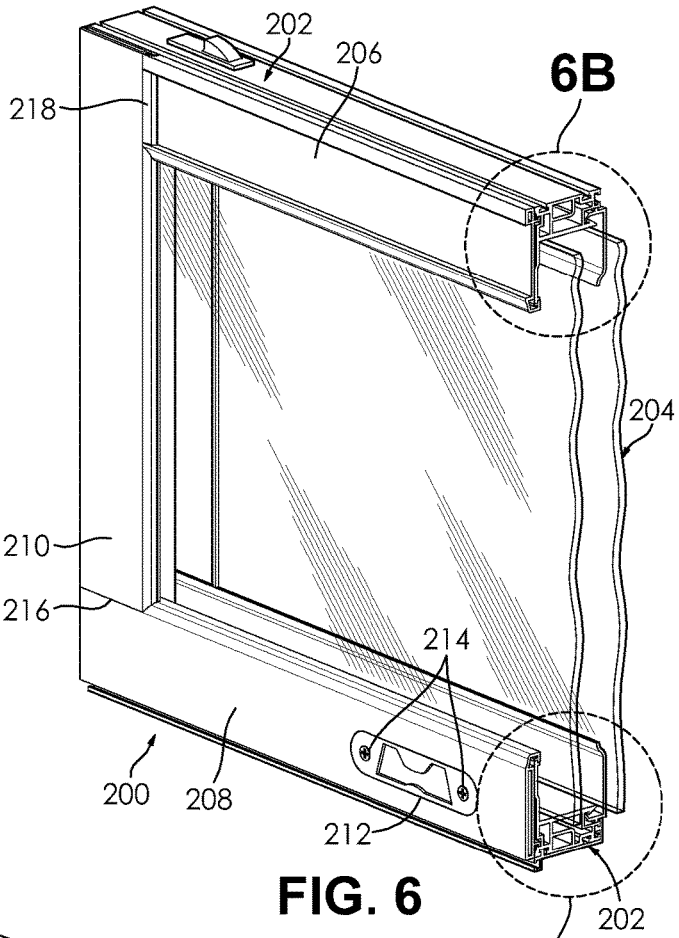
FIG. 6 is a perspective view of the inside of portion of a top window sash showing top and bottom chassis rails, a left stile, inside and outside chassis stile covers, and inside and outside top and bottom chassis rail covers, with the covers installed.
Figure 7:
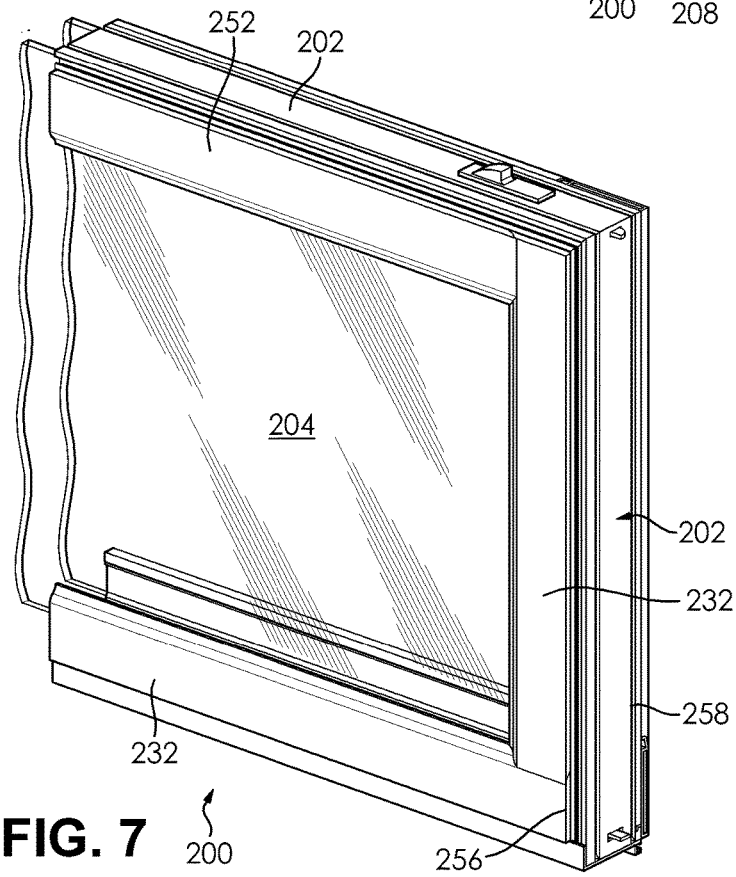
FIG. 7 is a perspective view of the outside of the portion of the top window sash shown in FIG. 6.

A portion of an upper sash unit incorporating an embodiment of the invention is indicated at 200 in FIGS. 6 and 7. FIG. 6 shows the unit 200 from the inside and FIG. 7 shows the unit 200 from the outside. The unit 200 comprises a welded chassis 202 with a glazing unit 204 secured therein. An inside top rail cover 206, an inside bottom rail cover 208, an inside left stile cover 210, and an inside right stile cover (not shown) are supported on the chassis 202, as by engagement between cover engagement members and chassis engagement members in the manner described above.

A lock keeper 212 is secured to the bottom chassis rail by fasteners 214. Longitudinal movement, to the left or the right, of the bottom rail cover 208, relative to the bottom chassis rail may be prevented by the lock keeper 212 and/or the fasteners 214. Downward movement of the left stile cover 210 is prevented by engagement between a lower end 216 of the left stile cover 210 and the bottom rail cover 208. Upward movement of the inside left stile cover 210, from the position shown in FIG. 6 is prevented by engagement between at least one stop member provided on the inside left stile cover and at least one stop member provided on the top chassis rail, in a manner described above with reference to FIGS. 1 through 4. Longitudinal movement of the inside top rail cover 206, to the left in FIG. 6, may be prevented by engagement between an end 218 of the top rail cover 206 and the left stile cover 210. Upward movement of the right inside stile cover (not shown) may be prevented in the manner that such movement is prevented for the left inside stile cover 210.

The inside bottom rail cover 208, as seen in FIG. 6A, is attached to and supported on a bottom chassis rail 222. Specifically, a first bottom rail cover engagement member 224 is engaged with a first bottom chassis rail engagement member 226. In this example, engagement member 224 is a groove and engagement member 226 is a ridge. A second bottom rail cover engagement member 228 is engaged with a first bottom chassis rail engagement member 230. In this example, engagement member 228 is a ridge and engagement member 230 is a groove.

An outside bottom rail cover 232 is attached to and supported on the bottom chassis rail 222. Specifically, a first outside bottom rail cover engagement member 234 is engaged with a first bottom chassis rail engagement member 236. In this example, engagement member 234 is a groove and engagement member 236 is a ridge. A second outside bottom rail cover engagement member 238 is engaged with a first bottom chassis rail engagement member 240. In this example, engagement member 238 is a ridge and engagement member 240 is a groove.

Figure 6B:
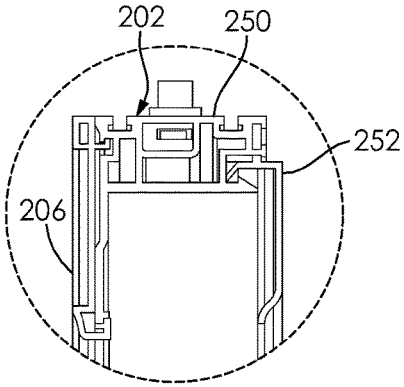
FIG. 6B is a cross sectional view of the top rail of the top sash shown in FIG. 6.

The inside top rail cover 206, as seen in FIG. 6B, is attached to and supported on a top chassis rail 250. Specifically, the inside top rail cover 206 is attached to the top chassis rail 250 in the manner in which the inside bottom rail cover 208 is attached to and supported on the bottom chassis rail 222. An outside top rail cover 252 is attached to the top chassis rail 250 in the manner in which the outside bottom rail cover 232 is attached to and supported on the bottom chassis rail 222.

Figure 8A:
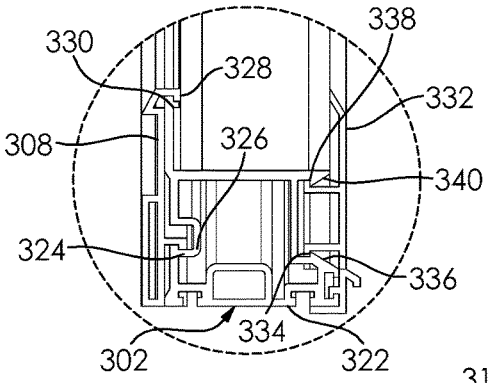
FIG. 8A is a cross sectional view of the bottom rail of the bottom sash shown in FIG. 8.
Figure 8:
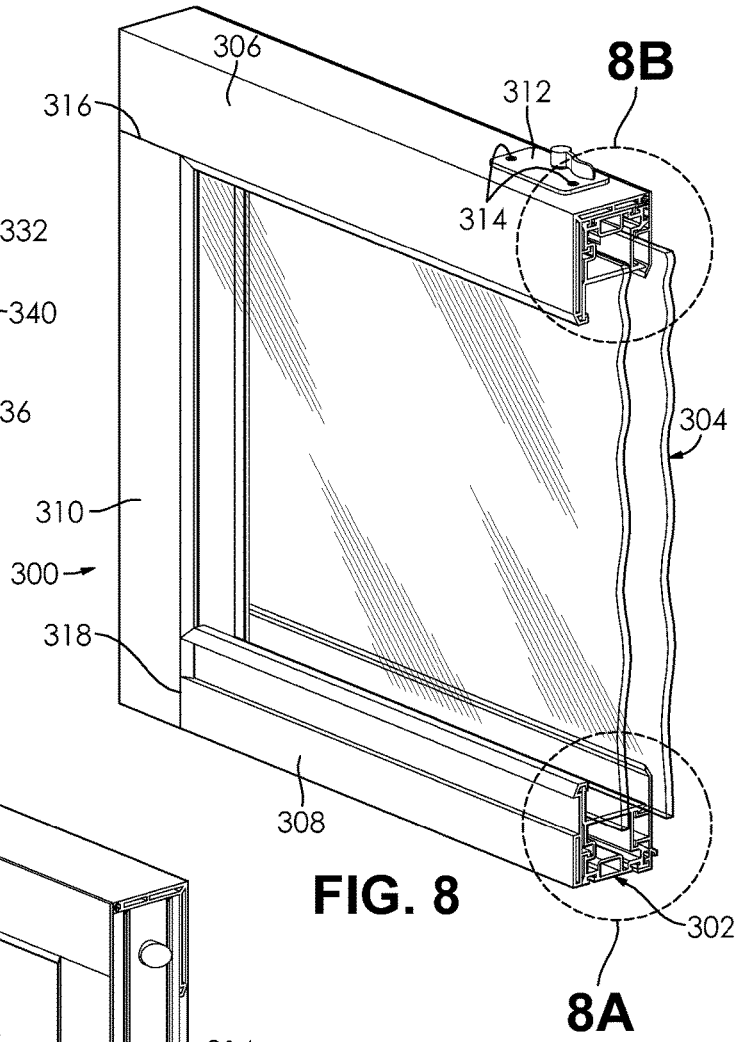
FIG. 8 is a perspective view of the inside of portion of a bottom window sash showing top and bottom chassis rails, a left stile, inside and outside chassis stile covers, and inside and outside top and bottom chassis rail covers, with the covers installed.
Figure 9:
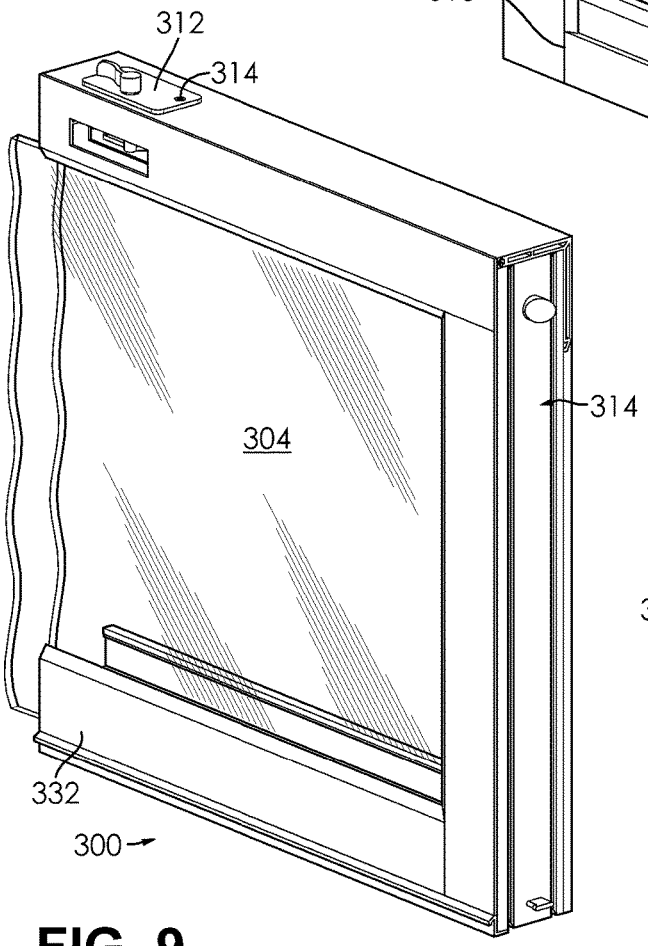
FIG. 9 is a perspective view of the outside of the portion of the top window sash shown in FIG. 8.

A portion of a lower sash unit incorporating an embodiment of the invention is indicated at 300 in FIGS. 8 and 9. FIG. 8 shows the unit 300 from the inside and FIG. 9 shows the unit 300 from the outside. The unit comprises a welded chassis 302 with a glazing unit 304 secured therein. An inside top rail cover 306, an inside bottom rail cover 308, an inside left stile cover 310, and an inside right stile cover (not shown) are supported on the chassis 302, as by engagement between cover engagement members and chassis engagement members in a manner similar to the cover and chassis engagement described above with references to FIGS. 1 through 7. The inside top rail cover 306 is L-shaped with one leg covering the exterior or top of the top chassis rail, and the other leg covering the inside surface of the top chassis rail.

A lock 312 is secured to the top chassis rail by fasteners 314. Longitudinal movement, to the left or the right, of the top rail cover 306, relative to the bottom chassis rail may be prevented by the lock 312 and/or the fasteners 314. Upward movement of the left inside stile cover 310 is prevented by engagement between an upper end 316 of the left inside stile cover 310 and the top rail cover 306. Downward movement of the inside left stile cover 310, from the position shown in FIG. 8 is prevented by engagement between at least one stop member provided on the inside left stile cover and at least one stop member provided on the bottom chassis rail, in a manner such as the one described above with reference to FIGS. 1 through 7. Longitudinal movement of the bottom rail cover 306, to the left in FIG. 8, may be prevented by engagement between an end 318 of the bottom rail cover 308 and the left stile cover 310. Downward movement of the right inside stile cover (not shown) may be prevented in the manner that such movement is prevented for the left inside stile cover 310.

The inside bottom rail cover 308, as seen in FIG. 8A, is attached to and supported on a bottom chassis rail 322. Specifically, a first bottom rail cover engagement member 324 is engaged with a first bottom chassis rail engagement member 326. A second bottom rail cover engagement member 328 is engaged with a second bottom chassis rail engagement member 230.

An outside bottom rail cover 332 is attached to and supported on the bottom chassis rail 322. Specifically, a first outside bottom rail cover engagement member 334 is engaged with a first outside bottom chassis rail engagement member 336. In this example, engagement member 334 is a ridge and engagement member 336 is a groove. A second outside bottom rail cover engagement member 338 is engaged with a second outside bottom chassis rail engagement member 340. In this example, engagement member 338 is a ridge and engagement member 340 is a groove.

Figure 8B:
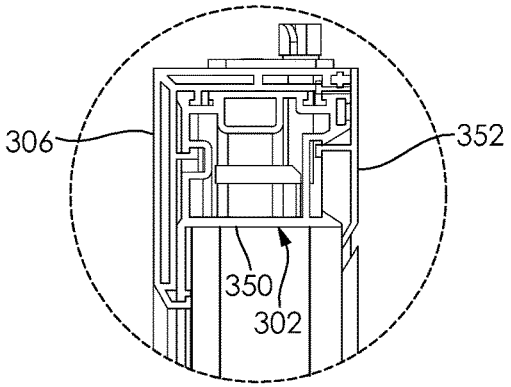
FIG. 8B is a cross sectional view of the bottom rail of the bottom sash shown in FIG. 8.

The L-shaped inside top rail cover 306, as seen in FIG. 8B, is attached to and supported on a top chassis rail 350. Specifically, the inside top rail cover 306 is attached to the top chassis rail 350 in the manner in which the inside bottom rail cover 308 is attached to and supported on the bottom chassis rail 322 by cooperating engagement means and/or the lock 312. An outside top rail cover 352 is attached to the top chassis rail 350 in the manner in which the outside bottom rail cover 332 is attached to and supported on the bottom chassis rail 322.

Figure 10:
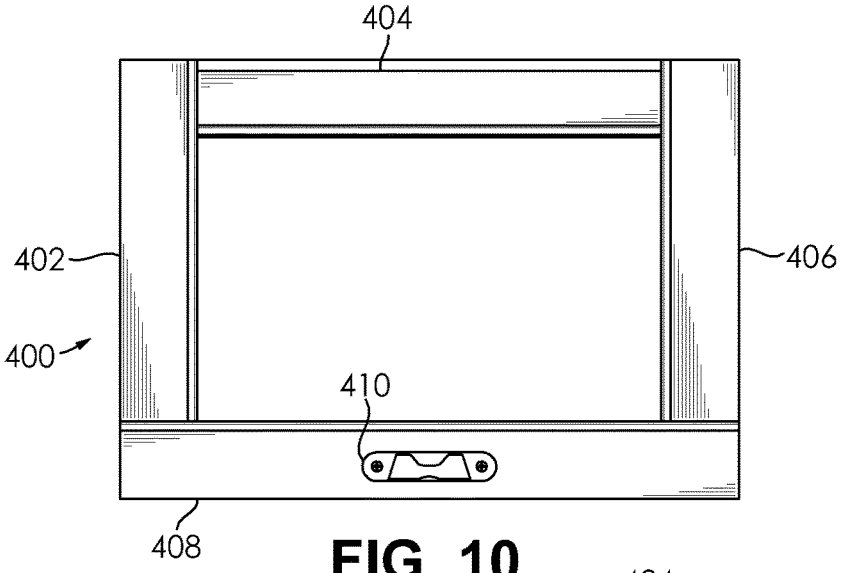
FIG. 10 is a view of the inside of a top window sash showing a preferred configuration for inside rail and stile covers.

A preferred orientation and sizing of inside chassis covers in an upper sash unit 400 are shown in FIG. 10. A left stile cover 402 extends upwardly to the exterior edge of the top chassis rail so that it engages the left end of a top rail cover 404 and prevents movement thereof to the left. A right stile cover 406 extends upwardly to the exterior edge of the top chassis rail so that it engages the right end of the top rail cover 404 and prevents movement thereof to the right. A bottom rail cover 408 extends from the exterior edge of the left chassis stile to the exterior edge of the right chassis stile. Upward movement of the left stile cover 402 from the position shown in FIG. 10 can be prevented by cooperating stop members provided on the left stile cover 402, and on the top chassis rail, as previously described. Upward movement of the right stile cover 406 from the position shown in FIG. 10 can be prevented by cooperating stop members provided on the right stile cover 406, and on the top chassis rail, as previously described. Movement of the bottom rail cover 408 to the left, and to the right, in FIG. 10 can be prevented by engagement with a lock keeper 410 and its engagement with the bottom chassis rail. Alternatively, or in combination with the lock keeper 410, movement of the bottom rail cover 408 to the left or to the right, from the position shown in FIG. 10 can be prevented by stop members provided on the bottom rail cover 408, and stop members provided on the left chassis stile and the right chassis stile, as previously described.

Figure 11:
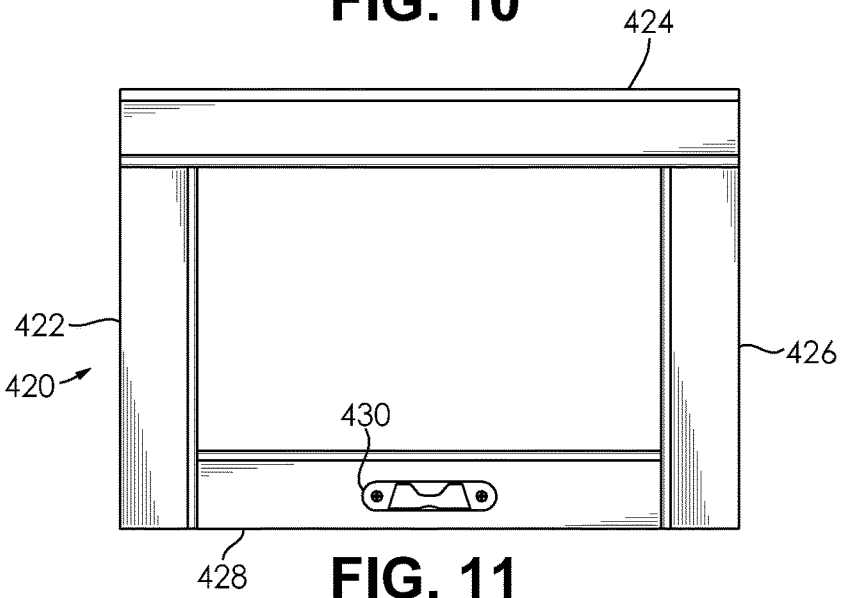
FIG. 11 is a view of the inside of a top window sash showing a second configuration for inside rail and stile covers.

An alternative orientation and sizing of inside chassis covers in an upper sash unit 420 are shown in FIG. 11. A left stile cover 422 extends upwardly so that its upper end engages a top rail cover 424, which prevents upward movement of the left stile cover 422. A right stile cover 426 extends upwardly so that its upper end engages the top rail cover 424, which prevents upward movement of the right stile cover 426. The left end and right end of a bottom rail cover 428 engage the lower ends of the left and right stile covers 422 and 426, trapping it between them to prevent the bottom rail cover 428 from moving to the right and from moving to the left.

Downward movement of the left stile cover 422 from the position shown in FIG. 11 can be prevented by cooperating stop members provided on the left stile cover 422, and on the bottom chassis rail, as previously described. Downward movement of the right stile cover 426 from the position shown in FIG. 11 can be prevented by cooperating stop members provided on the right stile cover 426, and on the bottom chassis rail, as previously described. Movement of the bottom rail cover 428 to the left, and to the right in FIG. 11 can also be prevented by engagement with lock keeper 430 and its engagement with the bottom chassis rail.

Figure 12:
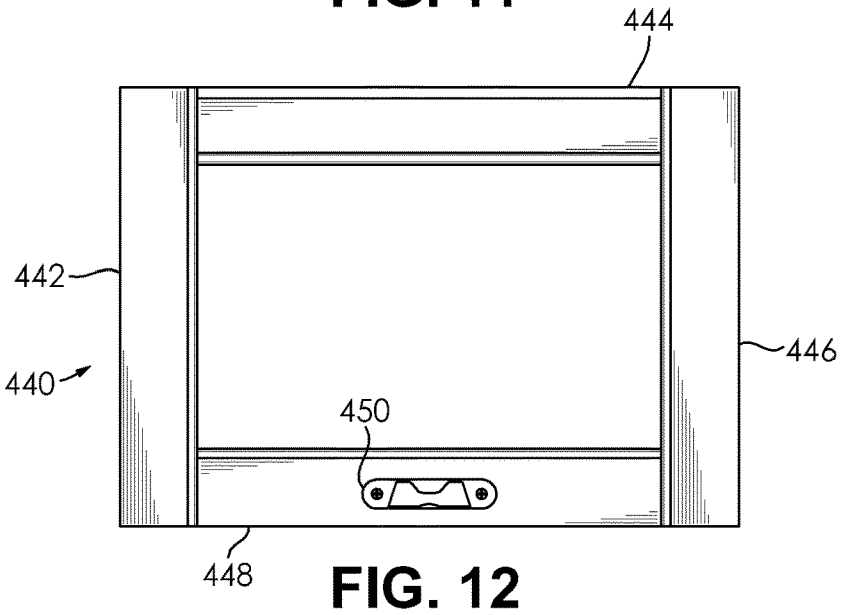
FIG. 12 is a view of the inside of a top window sash showing a third configuration for inside rail and stile covers.

An alternative orientation and sizing of inside chassis covers in an upper sash unit 440 are shown in FIG. 12. A left stile cover 442 extends from the exterior edge of the top chassis rail to the exterior edge of the bottom chassis rail. The left end of a top rail cover 444 engages the left stile cover 442 and the right end of the top rail cover 444 engages a right stile cover 446, which extends from the exterior edge of the top chassis rail to the exterior edge of the bottom chassis rail. The left end of a bottom rail cover 448 engages the left stile cover 442 and the right end of the bottom rail cover 448 engages the right stile cover 446. The top rail cover 444 and the bottom rail cover 448 are trapped between the left and right stile covers 442 and 446, which prevents the top and bottom rail covers 444 and 448 from moving to the right and from moving to the left. Upward and downward movement of the stile covers 442 and 446, from the positions shown in FIG. 12 can be prevented by cooperating stop members provided on the top and bottom chassis rails, and on the upper and lower ends of the stile covers 442 and 446, as previously described. Movement of the bottom rail cover 448 to the left and to the right in FIG. 12 is also prevented by engagement with a lock keeper 450 and its engagement with the bottom chassis rail.

Figure 13:
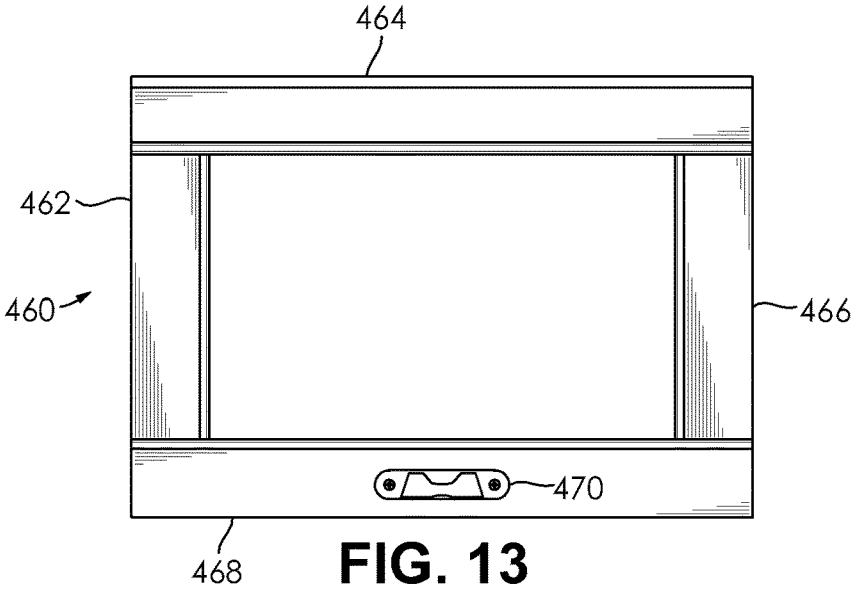
FIG. 13 is a view of the inside of a top window sash showing a fourth configuration for inside rail and stile covers.

An alternative orientation and sizing of inside chassis covers in an upper sash unit 460 are shown in FIG. 13. A left stile cover 462 extends upwardly so that its upper end engages a top rail cover 464. The cover 464 extends from the exterior edge of the left chassis stile to the exterior edge of the right chassis stile. A right stile cover 466 extends upwardly so that its end engages the top rail cover 464. A bottom rail cover 468 extends from the exterior edge of the left chassis stile to the exterior edge of the right chassis stile. The bottom end of the left stile cover 462 and the bottom end of the right stile cover 466 engage the bottom rail cover 468. The left and right stile covers 462 and 466 are trapped between the top and bottom rail covers 464 and 468, which prevents the stile covers 462 and 466 from moving up and from moving down. Movement of the top rail cover 464 from the position shown in FIG. 13 can be prevented by cooperating stop members provided on top rail cover 464 and on the left chassis stile and on the right chassis stile, as previously described. Movement of the bottom rail cover 468 to the left and to the right in FIG. 13 can be prevented by engagement with a lock keeper 470 and its engagement with the bottom chassis rail. Movement of the bottom rail cover 468 from the position shown in FIG. 13 can also be prevented by cooperating stop members provided on rail cover 468 and on the left chassis stile and on the right chassis stile, as previously described.

Figure 14:
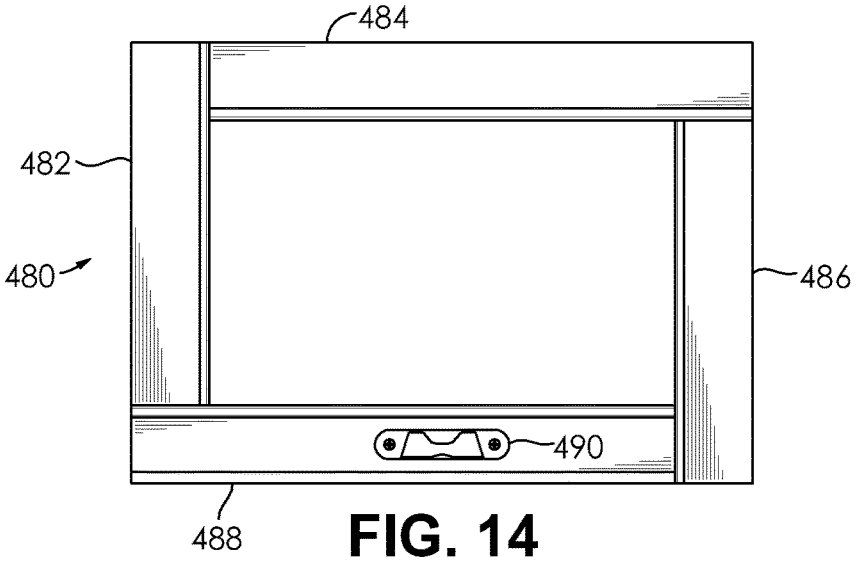
FIG. 14 is a view of the inside of a top window sash showing a fifth configuration for inside rail and stile covers.

An alternative orientation and sizing of inside chassis covers in an upper sash unit 480 are shown in FIG. 14. A left stile cover 482 extends upwardly to the exterior edge of the top chassis rail. A top rail cover 484 extends from the left stile cover 482 to the exterior edge of the right chassis stile. A right stile cover 486 extends from the top rail cover 484 to the exterior edge of the bottom chassis rail. A bottom rail cover 488 extends from the right stile cover 486 to the exterior edge of the left chassis stile. Movement of the left stile cover 482 downwardly, movement of the top rail cover 484 to the left, movement of the right stile cover 486 upwardly, and movement of the bottom rail cover 488 to the right, are prevented by the bottom rail cover 488, the left stile cover 482, the top rail cover 484, and the right stile cover 486, respectively. Upward movement of the left stile cover 482 from the position shown in FIG. 14 can be prevented by cooperating stop members provided on the left stile cover 482, and on the top chassis rail, as previously described. Movement of the top rail cover 484 to the right from the position shown in FIG. 14 can be prevented by cooperating stop members provided on the top rail cover 484, and on the right chassis stile as previously described. Downward movement of the right stile cover 486 from the position shown in FIG. 14 can be prevented by cooperating stop members provided on the right stile cover 486, and on the bottom chassis rail, as previously described. Movement of the bottom rail cover 488 to the left, and to the right, in FIG. 14 can be prevented by engagement with a lock keeper 490 and its engagement with the bottom chassis rail. Movement of the bottom rail cover 488 to the left from the position shown in FIG. 14 can also be prevented by engagement between cooperating stop members provided on the bottom rail cover 488 and on the left chassis stile.

Figure 15:
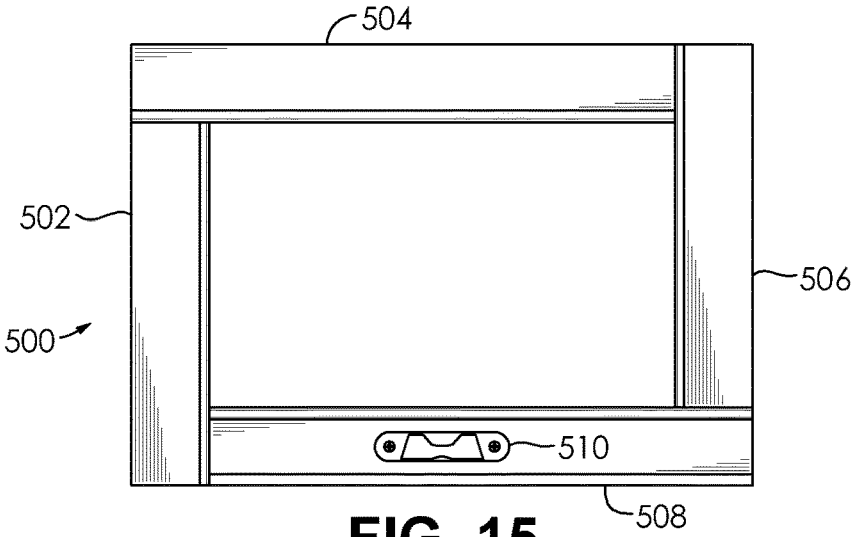
FIG. 15 is a view of the inside of a top window sash showing a sixth configuration for inside rail and stile covers.

An alternative orientation and sizing of inside chassis covers in an upper sash unit 500 are shown in FIG. 15. A left stile cover 502 extends downwardly to the exterior edge of the bottom chassis rail. A top rail cover 504 extends from a right stile cover 506 to the exterior edge of the left chassis stile. The right stile cover 506 extends from a bottom rail cover 508 to the exterior edge of the top chassis rail. The bottom rail cover 508 extends from the left stile cover 502 to the exterior edge of the right chassis stile. Movement of the left stile cover 502 upwardly, movement of the top rail cover 504 to the right, movement of the right stile cover 506 downwardly, and movement of the bottom rail cover 508 to the left, are prevented by the top rail cover 504, the right stile cover 506, the bottom rail cover 508, and the left stile cover 502, respectively. Downward movement of the left stile cover 502 from the position shown in FIG. 15 can be prevented by cooperating stop members provided on the left stile cover 502, and on the bottom chassis rail, as previously described. Movement of the top rail cover 504 to the left from the position shown in FIG. 15 can be prevented by cooperating stop members provided on the top rail cover 504, and on the left chassis stile as previously described. Upward movement of the right stile cover 506 from the position shown in FIG. 15 can be prevented by cooperating stop members provided on the right stile cover 506, and on the top chassis rail, as previously described. Movement of the bottom rail cover 508 to the left, and to the right, in FIG. 15 can be prevented by engagement with a lock keeper 510 and its engagement with the bottom chassis rail. Movement of the bottom rail cover 508 to the right from the position shown in FIG. 15 can also be prevented by cooperating stop members provided on bottom rail cover 508 and on the right chassis stile.

Figure 16:
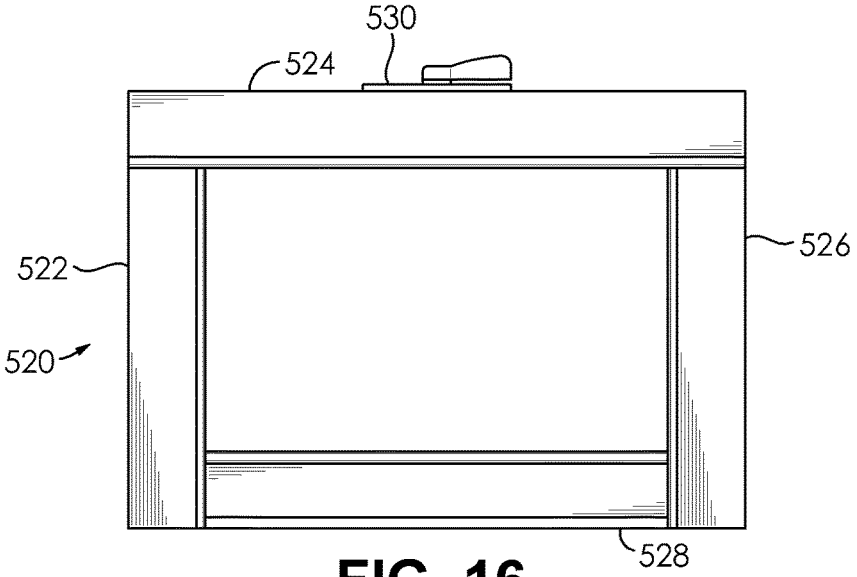
FIG. 16 is a view of the inside of a bottom window sash showing a preferred configuration for inside rail and stile covers.

An alternative orientation and sizing of inside chassis covers in a lower sash unit 520 are shown in FIG. 16. A left stile cover 522 extends upwardly so that its upper end engages a top rail cover 524, which prevents upward movement of the left stile cover 522. A right stile cover 526 extends upwardly so that its upper end engages the top rail cover 524, which prevents upward movement of the right stile cover 526. The left end and right end of a bottom rail cover 528 engage the lower ends of the left and right stile covers 522 and 526, trapping it between them to prevent the bottom rail cover 528 from moving to the right and from moving to the left. Downward movement of the left stile cover 522 from the position shown in FIG. 16 can be prevented by cooperating stop members provided on the left stile cover 522, and on the bottom chassis rail, as previously described. Downward movement of the right stile cover 526 from the position shown in FIG. 16 can be prevented by cooperating stop members provided on the right stile cover 526, and on the bottom chassis rail, as previously described. Movement of the top rail cover 524 to the left, and to the right in FIG. 16 can also be prevented by engagement with lock 530 and its engagement with the top chassis rail.

Figure 17:
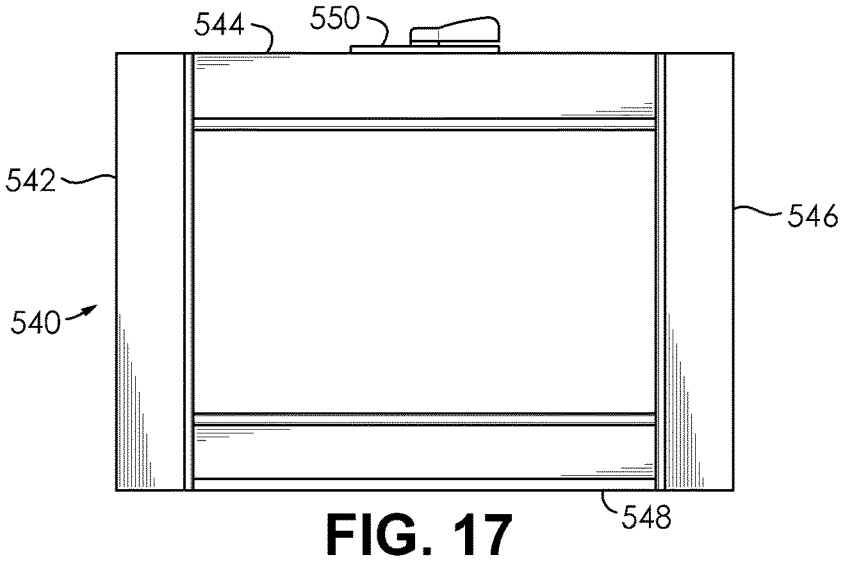
FIG. 17 is a view of the inside of a bottom window sash showing a second configuration for inside rail and stile covers.

An alternative orientation and sizing of inside chassis covers in a lower sash unit 540 are shown in FIG. 17. A left stile cover 542 extends from the exterior edge of the top chassis rail to the exterior edge of the bottom chassis rail. The left end of a top rail cover 544 engages the left stile cover 542 and the right end of the top rail cover 544 engages a right stile cover 546, which xtends from the exterior edge of the top chassis rail to the exterior edge of the bottom chassis rail. The left end of a bottom rail cover 548 engages the left stile cover 542 and the right end of the bottom rail cover 548 engages the right stile cover 546. The top rail cover 544 and the bottom rail cover 548 are trapped between the left and right stile covers 542 and 546, which prevents the top and bottom rail covers 544 and 548 from moving to the right and from moving to the left. Upward and downward movement of the stile covers 542 and 546, from the positions shown in FIG. 17 can be prevented by cooperating stop members provided on the top and bottom chassis rails, and on the upper and lower ends of the stile covers 542 and 546, as previously described. Movement of the top rail cover 544 to the left and to the right in FIG. 17 is also prevented by engagement with lock 550 and its engagement with the top chassis rail.

Figure 18:
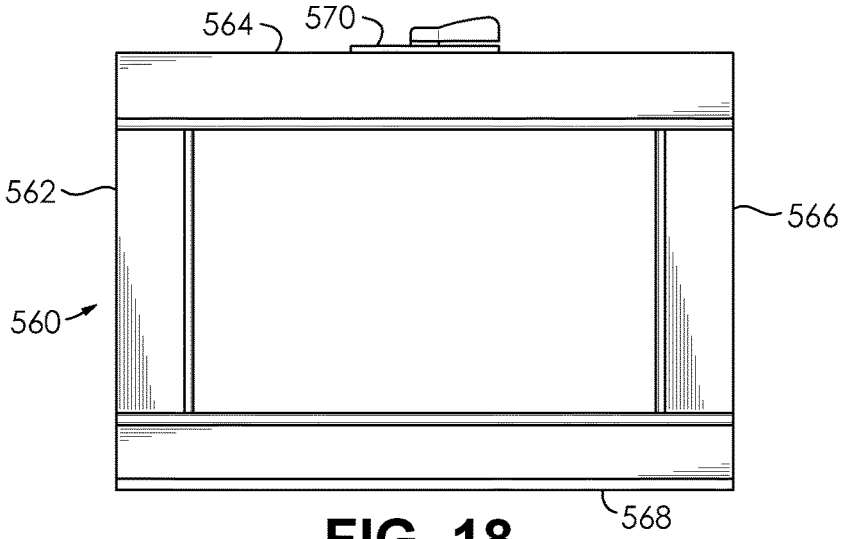
FIG. 18 is a view of the inside of a bottom window sash showing a third configuration for inside rail and stile covers.

An alternative orientation and sizing of inside chassis covers in a lower sash unit 560 are shown in FIG. 18. A left stile cover 562 extends upwardly so that its upper end engages a top rail cover 564. The cover 564 extends from the exterior edge of the left chassis stile to the exterior edge of the right chassis stile. A right stile cover 566 extends upwardly so that its end engages the top rail cover 564. A bottom rail cover 568 extends from the exterior edge of the left chassis stile to the exterior edge of the right chassis stile. The bottom end of the left stile cover 562 and the bottom end of the right stile cover 566 engage the bottom rail cover 568. The left and right stile covers 562 and 566 are trapped between the top and bottom rail covers 564 and 568, which prevents the stile covers 562 and 566 from moving up and from moving down. Movement of the top rail cover 564 from the position shown in FIG. 18 can be prevented by cooperating stop members provided on top rail cover 564 and on the left chassis stile and on the right chassis stile, as previously described. Movement of the top rail cover 564 to the left and to the right in FIG. 18 can be prevented by engagement with lock 570 and its engagement with the bottom chassis rail. Movement of the top and bottom rail covers 564 and 568 from the positions shown in FIG. 18 can also be prevented by cooperating stop members provided on top rail cover 564 and bottom rail cover 568 and on the left chassis stile and on the right chassis stile, as previously described.

Figure 19:
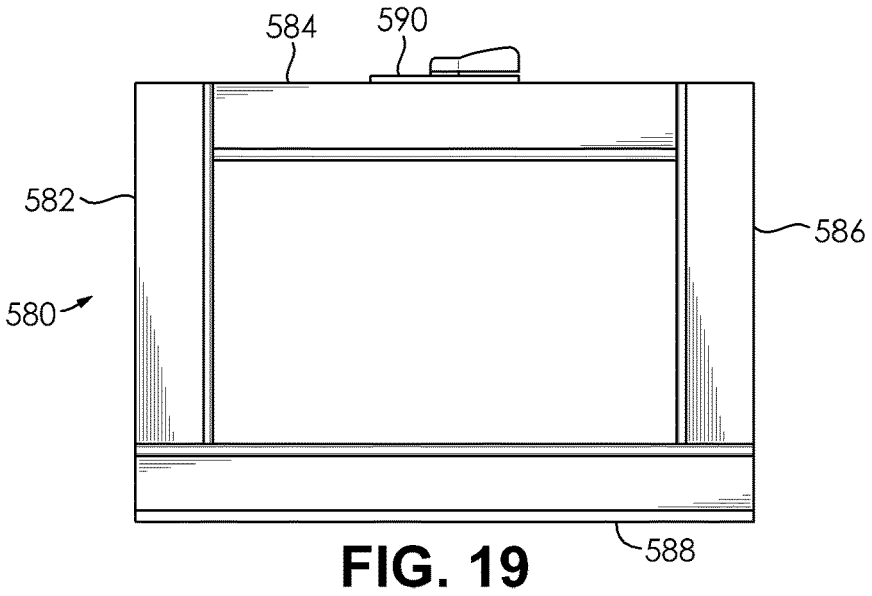
FIG. 19 is a view of the inside of a bottom window sash showing a fourth configuration for inside rail and stile covers.

A preferred orientation and sizing of inside chassis covers in a lower sash unit 580 are shown in FIG. 19. A left stile cover 582 extends upwardly to the exterior edge of the top chassis rail so that it engages the left end of a top rail cover 584 and prevents movement thereof to the left. A right stile cover 586 extends upwardly to the exterior edge of the top chassis rail so that it engages the right end of the top rail cover 584 and prevents movement thereof to the right. A bottom rail cover 588 extends from the exterior edge of the left chassis stile to the exterior edge of the right chassis stile. Upward movement of the left stile cover 582 from the position shown in FIG. 19 can be prevented by cooperating stop members provided on the left stile cover 582, and on the top chassis rail, as previously described. Upward movement of the right stile cover 586 from the position shown in FIG. 19 can be prevented by cooperating stop members provided on the right stile cover 586, and on the top chassis rail, as previously described. Movement of the top rail cover 584 to the left, and to the right, in FIG. 19 can be prevented by engagement with the lock 590 and its engagement with the top chassis rail. Alternatively, or in combination with the lock 590, movement of the top rail cover 584 to the left or to the right, from the position shown in FIG. 19 can be prevented by stop members provided on the top rail cover 584, and stop members provided on the left chassis stile and the right chassis stile, as previously described. Movement of the bottom rail cover 588 to the left or to the right, from the position shown in FIG. 19 can be prevented by stop members provided on the bottom rail cover 588, and stop members provided on the left chassis stile and the right chassis stile, as previously described.

Figure 20:
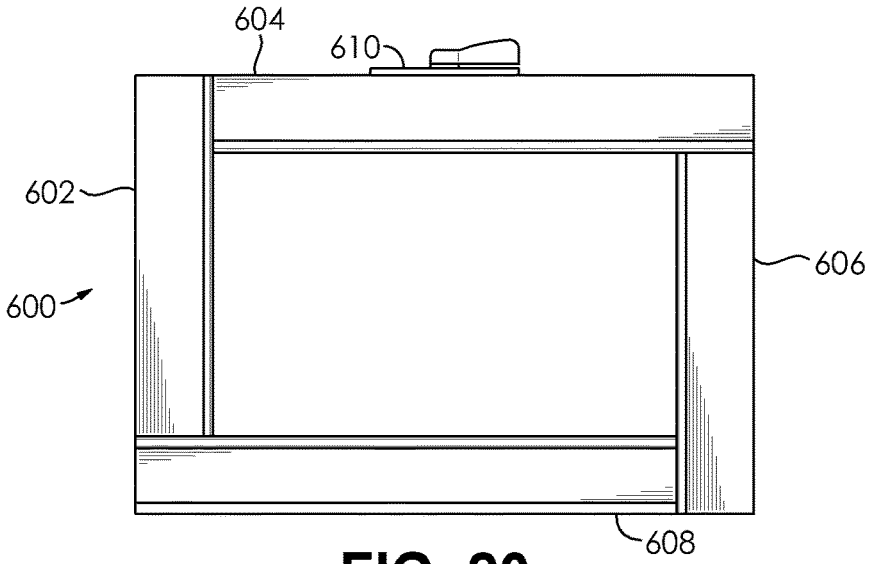
FIG. 20 is a view of the inside of a bottom window sash showing a fifth configuration for inside rail and stile covers.

An alternative orientation and sizing of inside chassis covers in a bottom sash unit 600 are shown in FIG. 20. A left stile cover 602 extends upwardly to the exterior edge of the top chassis rail. A top rail cover 604 extends from the left stile cover 602 to the exterior edge of the right chassis stile. A right stile cover 606 extends from the top rail cover 604 to the exterior edge of the bottom chassis rail. A bottom rail cover 608 extends from the right stile cover 606 to the exterior edge of the left chassis stile. Movement of the left stile cover 602 downwardly, movement of the top rail cover 604 to the left, movement of the right stile cover 606 upwardly, and movement of the bottom rail cover 608 to the right, are prevented by the bottom rail cover 608, the left stile cover 602, the top rail cover 604, and the right stile cover 606, respectively. Upward movement of the left stile cover 602 from the position shown in FIG. 20 can be prevented by cooperating stop members provided on the left stile cover 602, and on the top chassis rail, as previously described. Movement of the top rail cover 604 to the right from the position shown in FIG. 20 can be prevented by cooperating stop members provided on the top rail cover 604, and on the right chassis stile as previously described. Downward movement of the right stile cover 606 from the position shown in FIG. 20 can be prevented by cooperating stop members provided on the right stile cover 606, and on the bottom chassis rail, as previously described. Movement of the top rail cover 604 to the right, in FIG. 20 can be prevented by engagement with the lock 610 and its engagement with the top chassis rail. Movement of the top rail cover 604 to the right from the position shown in FIG. 20 can be prevented by engagement between cooperating stop members provided on the top rail cover 604 and on the right chassis stile. Movement of the bottom rail cover 608 to the left from the position shown in FIG. 20 can be prevented by engagement between cooperating stop members provided on the bottom rail cover 608 and on the left chassis stile.

Figure 21:
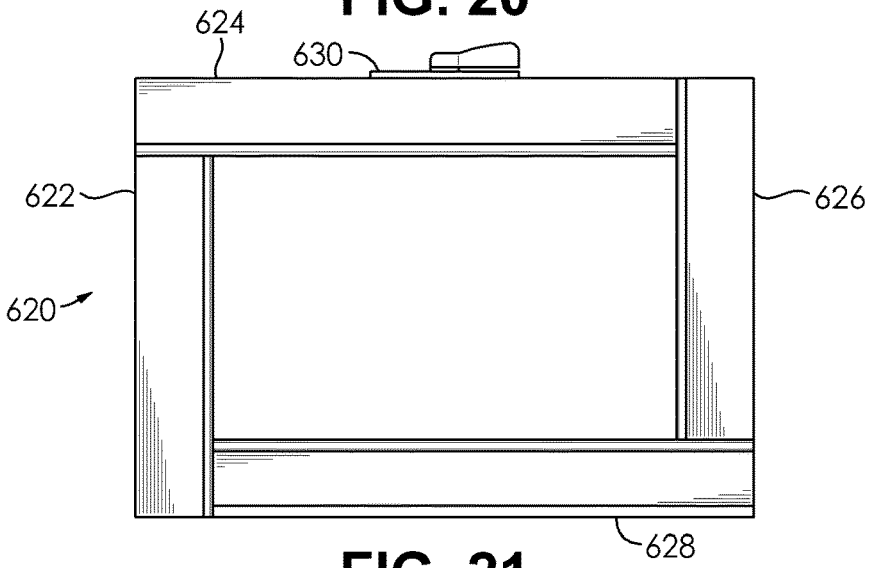
FIG. 21 is a view of the inside of a bottom window sash showing a sixth configuration for inside rail and stile covers.

An alternative orientation and sizing of inside chassis covers in a lower sash unit 620 are shown in FIG. 21. A left stile cover 622 extends downwardly to the exterior edge of the bottom chassis rail. A top rail cover 624 extends from a right stile cover 626 to the exterior edge of the left chassis stile. The right stile cover 626 extends from a bottom rail cover 628 to the exterior edge of the top chassis rail. The bottom rail cover 628 extends from the left stile cover 622 to the exterior edge of the right chassis stile. Movement of the left stile cover 622 upwardly, movement of the top rail cover 624 to the right, movement of the right stile cover 626 downwardly, and movement of the bottom rail cover 628 to the left, are prevented by the top rail cover 624, the right stile cover 626, the bottom rail cover 628, and the left stile cover 622, respectively. Downward movement of the left stile cover 622 from the position shown in FIG. 21 can be prevented by cooperating stop members provided on the left stile cover 622, and on the bottom chassis rail, as previously described. Movement of the top rail cover 624 to the left from the position shown in FIG. 20 can be prevented by cooperating stop members provided on the top rail cover 624, and on the left chassis stile as previously described. Upward movement of the right stile cover 626 from the position shown in FIG. 21 can be prevented by cooperating stop members provided on the right stile cover 626, and on the top chassis rail, as previously described. Movement of the top rail cover 624 to the left, and to the right, in FIG. 21 can be prevented by engagement with the lock 630 and its engagement with the top chassis rail. Movement of the top rail cover 624 to the left from the position shown in FIG. 21 can also be prevented by cooperating stop members provided on the top rail cover 624 and on the left chassis stile. Movement of the bottom rail cover 628 to the right from the position shown in FIG. 21 can also be prevented by cooperating stop members provided on bottom rail cover 628 and on the left chassis stile.

What is claimed is:

1. A fenestration system comprising:

a chassis, the chassis formed from a left chassis stile, a right chassis stile, a top chassis rail and a bottom chassis rail, the left and right chassis stile, and the top and bottom chassis rails formed from a polymeric material, the left and right chassis stile each having an outside surface with an outside longitudinal stile groove and an outside longitudinal stile ridge, the left and right outside stile grooves each defined by opposing walls having smooth surfaces, the left and right chassis stile each having an inside surface with an inside longitudinal stile groove and an inside longitudinal stile ridge, the left and right inside stile grooves each defined by opposing walls having smooth surfaces, the top and bottom chassis rails each having an outside surface with an outside longitudinal stile groove and an outside longitudinal stile ridge, the top and bottom outside rail grooves each defined by opposing walls having smooth surfaces, the top and bottom chassis rails each having an inside surface with at least one longitudinal inside groove and an inside longitudinal ridge, each of the top and bottom inside longitudinal rail grooves each defined by opposing walls having smooth surfaces;

a plurality of outside chassis stile covers each having a first longitudinal outside ridge configured to engage the longitudinal outside stile groove of a chassis stile and further having a second longitudinal outside ridge configured to engage the longitudinal outside ridge of a chassis stile, each of the first and second outside ridges of the outside chassis stile cover having a hook edge, each of the plurality of outside chasses stile covers formed from a polymeric material;

a plurality of inside chassis stile covers each having a longitudinal inside ridge configured to engage the inside longitudinal stile groove of a chassis stile and further having a longitudinal inside groove configured to engage the longitudinal ridge of a chassis stile, each of the plurality of inside chasses stile covers formed from a polymeric material;

a plurality of outside chassis rail covers each having a first longitudinal outside ridge configured to engage the longitudinal outside rail groove of a chassis rail and further having a second longitudinal outside ridge configured to engage the longitudinal outside ridge of a chassis rail, each of the first and second ridges of the outside chassis rail covers having a hook edge, each of the plurality of outside chasses rail covers formed from a polymeric material; and a plurality of inside chassis rail covers each having a longitudinal inside ridge configured to engage the inside longitudinal groove of a chassis rail and further having a longitudinal inside groove configured to engage the longitudinal ridge of a chassis rail, each of the plurality of inside chasses rail covers formed from a polymeric material.

2. The fenestration system of claim 1, wherein the chassis stiles and the chassis rails intersect at corners, and wherein the corners are joined by welds.

3. The fenestration system of claim 1, wherein at least one of the chassis stile covers has a stop member.

4. The fenestration system of claim 1, wherein at least one of the chassis rail covers has a stop member.

5. The fenestration system of claim 4, wherein the stop member prevents longitudinal movement of the chassis rail cover.

6. The fenestration system of claim 1, wherein at least one of the left chassis stile, right chassis stile, top chassis rail, and bottom chassis rail has a stop member.

7. The fenestration system of claim 6, wherein the stop member prevents longitudinal movement of the chassis stile cover.

8. The fenestration system of claim 6, wherein the chassis stiles and the chassis rails having the same cross sectional profile.

9. The fenestration system of claim 1, wherein at least one of the inside or outside chassis stile covers has a length that is shorter than a height of the inside or outside chassis stiles.

10. The fenestration system of claim 1, wherein at least one of the inside or outside chassis rail covers has a length that is shorter than a length of the inside or outside chassis rails.

11. The fenestration system of claim 1, wherein in an installed arrangement, the stiles, rails, stile covers and rails covers form a window or door frame sash kit.

* * * * *